US011199318B2

(12) United States Patent
Liu

(10) Patent No.: US 11,199,318 B2
(45) Date of Patent: Dec. 14, 2021

(54) LIGHTING DEVICE

(71) Applicant: GUANGDONG OPPO MOBILE TELECOMMUNICATIONS CORP., LTD., Dongguan (CN)

(72) Inventor: Jia Liu, Dongguan (CN)

(73) Assignee: SHENZHEN HEYTAP TECHNOLOGY CORP., LTD., Guangdong (CN)

( * ) Notice: Subject to any disclaimer, the term of this patent is extended or adjusted under 35 U.S.C. 154(b) by 0 days.

(21) Appl. No.: 17/138,515

(22) Filed: Dec. 30, 2020

(65) Prior Publication Data

US 2021/0254818 A1 Aug. 19, 2021

(30) Foreign Application Priority Data

Feb. 19, 2020 (CN) ..... 202010103083.2

(51) Int. Cl.
*F21V 23/04* (2006.01)
*F21S 6/00* (2006.01)
(Continued)

(52) U.S. Cl.
CPC ..... *F21V 23/0492* (2013.01); *F21S 6/003* (2013.01); *F21V 21/26* (2013.01); *F21S 6/00* (2013.01);
(Continued)

(58) Field of Classification Search
CPC ..... F21V 21/06; F21V 21/26; F21V 21/28; F21V 21/29; F21V 23/002;
(Continued)

(56) References Cited

U.S. PATENT DOCUMENTS 5,716,126 A * 2/1998 Meyer ..... F16M 11/10 362/287
2011/0255274 A1* 10/2011 Coleman ..... F21L 4/04 362/183
(Continued)

FOREIGN PATENT DOCUMENTS

CN 2634272 Y 8/2004
CN 202085859 U 12/2011
(Continued)

OTHER PUBLICATIONS

International Search Report issued in corresponding International Application No. PCT/CN2020/140980, dated Mar. 17, 2021, 10 pages.
(Continued)

*Primary Examiner* — Alexander K Garlen
*Assistant Examiner* — Colin J Cattanach
(74) *Attorney, Agent, or Firm* — Hodgson Russ LLP

(57) ABSTRACT

A lighting device is disclosed in the present disclosure. The lighting device includes a support assembly, an illuminant assembly, and a switch assembly. The illuminant assembly is connected to the support assembly and capable of being rotated to the support assembly. When the illuminant assembly is rotated to a position at which an angle between the illuminant assembly and the support assembly is less than or equal to a first angle threshold, the switch assembly turns to an on-state. In this way, the lighting device has a function of a switch.

19 Claims, 9 Drawing Sheets

(51) Int. Cl.

| | |
|---|---|
| ***F21V 21/26*** | (2006.01) |
| ***F21Y 105/18*** | (2016.01) |
| ***F21Y 103/33*** | (2016.01) |
| ***F21V 21/06*** | (2006.01) |
| ***F21V 21/28*** | (2006.01) |
| ***F21Y 107/10*** | (2016.01) |
| ***F21Y 107/30*** | (2016.01) |
| ***F21V 21/29*** | (2006.01) |
| ***F21Y 103/30*** | (2016.01) |

(52) U.S. Cl.
CPC ..... *F21S 6/002* (2013.01); *F21S 6/005* (2013.01); *F21S 6/006* (2013.01); *F21S 6/007* (2013.01); *F21S 6/008* (2013.01); *F21V 21/06* (2013.01); *F21V 21/28* (2013.01); *F21V 21/29* (2013.01); *F21Y 2103/30* (2016.08); *F21Y 2103/33* (2016.08); *F21Y 2105/18* (2016.08); *F21Y 2107/10* (2016.08); *F21Y 2107/30* (2016.08)

(58) Field of Classification Search
CPC ..... F21V 23/0492; F21S 6/00; F21S 6/002; F21S 6/003; F21S 6/005; F21S 6/006; F21S 6/007; F21S 6/008; F21Y 2105/18; F21Y 2103/30; F21Y 2103/33; F21Y 2107/10; F21Y 2107/30
See application file for complete search history.

(56) References Cited

U.S. PATENT DOCUMENTS

| | | | | |
|---|---|---|---|---|
| 2012/0091903 | A1* | 4/2012 | Bembridge | F21V 23/0492 315/178 |
| 2012/0314418 | A1* | 12/2012 | Byrne | F21S 8/028 362/285 |
| 2016/0186966 | A1* | 6/2016 | Shen | F21S 6/005 403/144 |
| 2016/0215964 | A1* | 7/2016 | Feit | F21S 6/005 |
| 2017/0211787 | A1* | 7/2017 | Sattler | F21V 23/06 |
| 2018/0231235 | A1* | 8/2018 | Reynolds | F21V 23/005 |
| 2018/0340646 | A1* | 11/2018 | Mehdi | F16M 11/14 |
| 2019/0014643 | A1* | 1/2019 | Gharabegian | F21V 23/008 |
| 2019/0137083 | A1* | 5/2019 | Liu | F21V 14/02 |
| 2020/0232628 | A1* | 7/2020 | Yang | F21V 33/0004 |

FOREIGN PATENT DOCUMENTS

| | | | |
|---|---|---|---|
| CN | 206682690 | U | 11/2017 |
| CN | 206723930 | U | 12/2017 |
| CN | 107690552 | A | 2/2018 |
| CN | 207196168 | U | 4/2018 |
| CN | 108064328 | A | 5/2018 |
| CN | 208442618 | U | 1/2019 |
| CN | 208951756 | U | 6/2019 |
| EP | 2233825 | A1 | 9/2010 |
| JP | 2015076384 | A | 4/2015 |
| WO | 2018/120175 | A1 | 7/2018 |
| WO | 2019/056207 | A1 | 3/2019 |

OTHER PUBLICATIONS

European Search Report issued in corresponding European Application No. EP 20 21 7526, dated May 17, 2021, 9 pages.

* cited by examiner

LIGHTING DEVICE

CROSS REFERENCE TO RELATED APPLICATIONS

This application claims priority to Chinese Patent Application No. 202010103083.2, entitled "LIGHTING DEVICE" and filed on Feb. 19, 2020, which is incorporated herein by reference in its entirety.

BACKGROUND

The present disclosure relates to the technical field of electronic lightings, and in particular to a lighting device.

With the continuous development of electronic lighting technologies and the improvement of people's life, lighting devices are used not only for daily lighting but also for decorating houses. People nowadays have increasing demands in the designs, functions, and application scenarios of lighting devices, which are used in various applications to improve people's quality of life.

SUMMARY

One of the embodiments of the present disclosure discloses a lighting device. The lighting device may include a support assembly, an illuminant assembly, and a switch assembly. The support assembly is connected to the illuminant assembly, and the illuminant assembly is capable of being rotated relative to the support assembly. The switch assembly is turned to an on-state by the first illuminant assembly being rotated to a position at which an angle between the illuminant assembly and the support assembly is less than or equal to a first angle threshold, and the switch assembly turns to on-state.

BRIEF DESCRIPTION OF THE DRAWINGS

The accompanying drawings, which are incorporated herein and form a part of the specification, illustrate embodiments of the present disclosure and, together with the description, further serve to explain the principles of the present disclosure and to enable a person skilled in the pertinent art to make and use the present disclosure.

DETAILED DESCRIPTION

The detailed descriptions of the disclosure are provided below with reference to the accompanying drawings and the embodiments. The embodiments described below with reference to the accompanying drawings are only intended to explain the present disclosure and cannot be construed as a limitation to the present disclosure. Moreover, the embodiments described below are some but not all embodiments of the disclosure. The other embodiments that can be obtained without paying any creative efforts by those skilled in the art.

The term "embodiment" mentioned in the disclosure means that a specific technical feature or a structure or a specific function that is incorporated in an embodiment may be included in at least one embodiment of the disclosure. Within the scope that can be understood by those skilled in the art, no matter whether it is obvious or implicit, one embodiment described in the disclosure can be combined with some other one embodiment.

Figure 1:
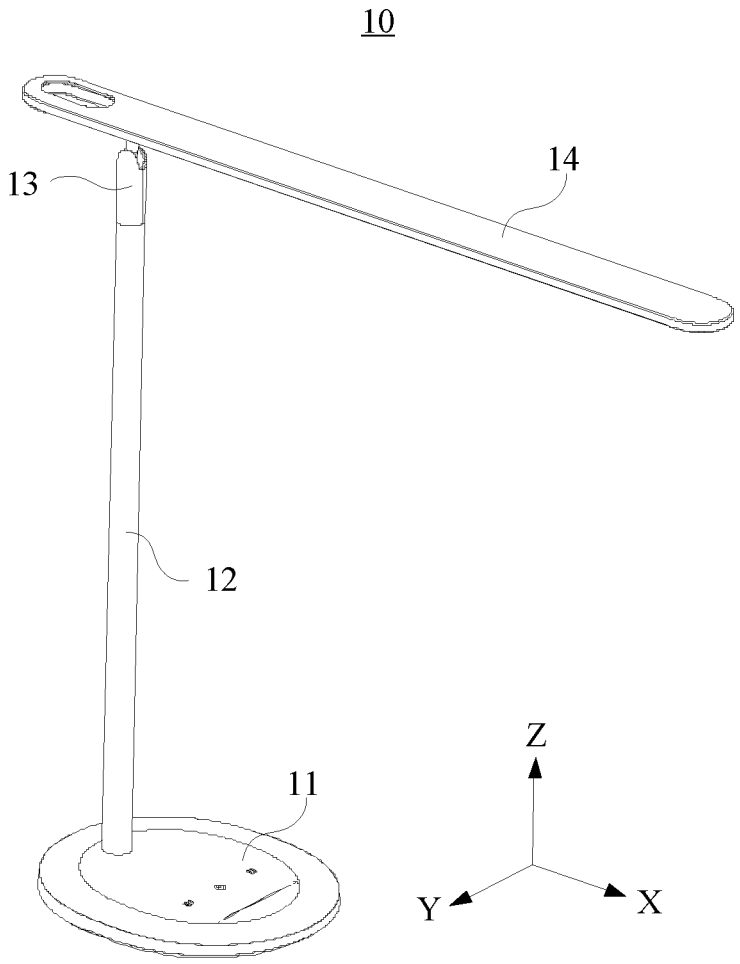
FIG. 1 is a structural schematic view of a lighting device, according to embodiments of the present disclosure.

As shown in FIG. 1, a structural schematic view of a lighting device according to an embodiment is provided. It should be pointed out that directions X and Y represent two horizontal directions that are perpendicular to each other, and direction Z represents the vertical direction that is orthogonal to directions X and Y (or plane XY). The three directions X, Y, and Z, are defined for the purpose of illustrating the three planes XY, XZ, and YZ, and the following embodiments. In some embodiments of the present disclosure, direction X represents the direction the illuminant assembly extends. In some embodiments, direction Y represents the direction support assembly 12 extends. Terms such as "up," "down," "left," "right," "front," "rear" are intended to illustrate the relative position relationship or motion relationship of the components of a lighting device (for example, as shown in FIG. 1). In some embodiments, terms such as "first," "second," and the like are used herein for purposes of description and are not intended to indicate or imply relative importance or significance or to imply the number of indicated technical features.

In the present disclosure, the term "connected to" can generally refer to "operatively coupled to" in all embodiments. In some embodiments, the term "connected to" refers to "operatively coupled to" and "in contact with."

In the embodiments as shown in FIG. 1, a lighting device 10 may be any suitable type of lamps such as a table lamp, a wall lamp, or a floor lamp. An illustrative description will be made in the embodiments based on an example that lighting device 10 is a table lamp. Lighting device 10 may include a support assembly 12, a rotatable assembly 13, an illuminant assembly 14, and a cable (shown as element 15 in FIGS. 2, 11, and 12). Support assembly 12 may include a base assembly 11. Base assembly 11 may support lighting device 10 and improve the structural stability of lighting device 10. Base assembly 11 may be connected to (e.g., an in contact with) one end of support assembly 12 that is away from illuminant assembly 14. Base assembly 11 may be placed on any suitable surface such as a desk or a night table. In some other embodiments, base assembly 11 includes a clamp that can be fastened/attached to an edge of a desk or a table.

Support assembly 12 may be configured to support illuminant assembly 14. Support assembly 12 may have any suitable shape, such as a columnar shape or a plate shape.

One end of rotatable assembly 13 may be connected to (e.g., and in contact with) support assembly 12, and the other end of rotatable assembly 13 may be connected to (e.g., and in contact with) illuminant assembly 14, so that illuminant assembly 14 can be rotated to support assembly 12. In various embodiments, illuminant assembly 14 is rotatable to support assembly 12 because of rotatable assembly 13. The detailed structure of rotatable assembly 13 will be described below.

In some embodiments, each of support assembly 12 and rotatable assembly 13 may be hollow inside so that the cable can be routed in support assembly 12 and rotatable assembly 13. In some embodiments, the placement of the cable, e.g., being inside lighting device 10, improves the consistency of the visible structure of lighting device 10.

Illuminant assembly 14 may have any suitable shape/structure, such as a bar-shaped structure, a disk-shaped structure, or a columnar structure. The cable may be electrically connected to illuminant assembly 14 and configured to conduct electricity to illuminant assembly 14 such that illuminant assembly 14 can emit light.

Figure 2:
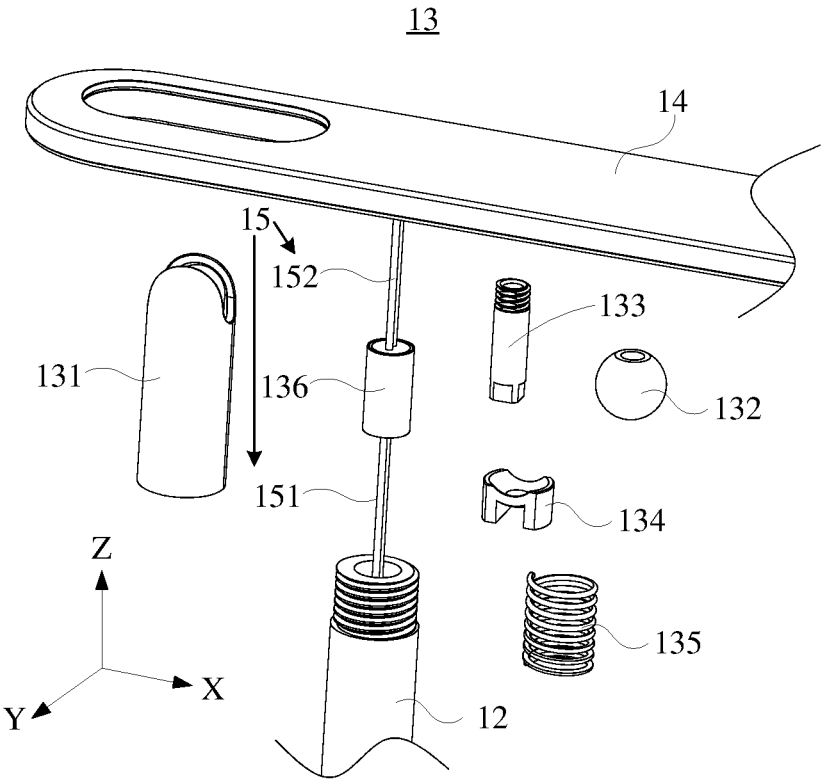
FIG. 2 is an exploded schematic view of a rotatable assembly shown in FIG. 1, according to an embodiment of the present disclosure.

FIG. 2 illustrates various parts of the rotatable assembly 13 shown in FIG. 1. It should be pointed out that support assembly 12 and illuminant assembly 14 illustrated in FIG. 2 are to illustrate an exemplary assembling relationship between rotatable assembly 13 and illuminant assembly 14. Cable 15 shown in FIG. 2 provides an exemplary arrangement of the cable routed in support assembly 12 and rotatable assembly 13.

Figure 3:
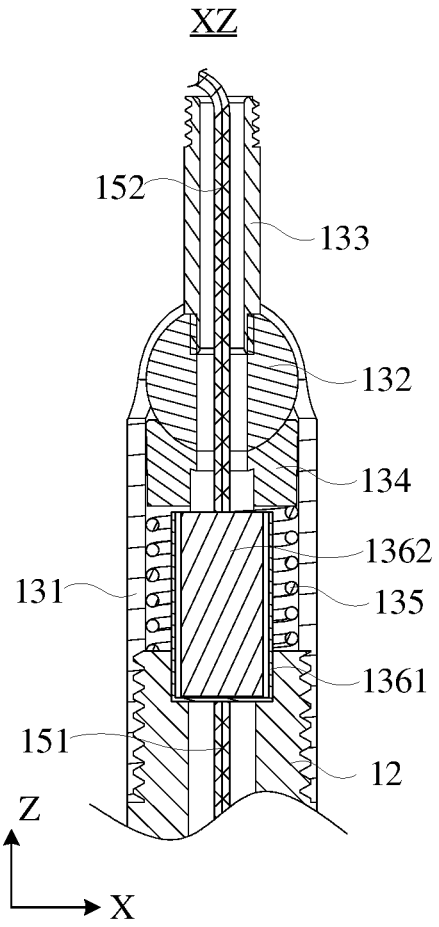
FIG. 3 is a cross-sectional view along the XZ plane of the rotatable assembly shown in FIG. 2, according to embodiments of the present disclosure.
Figure 4:
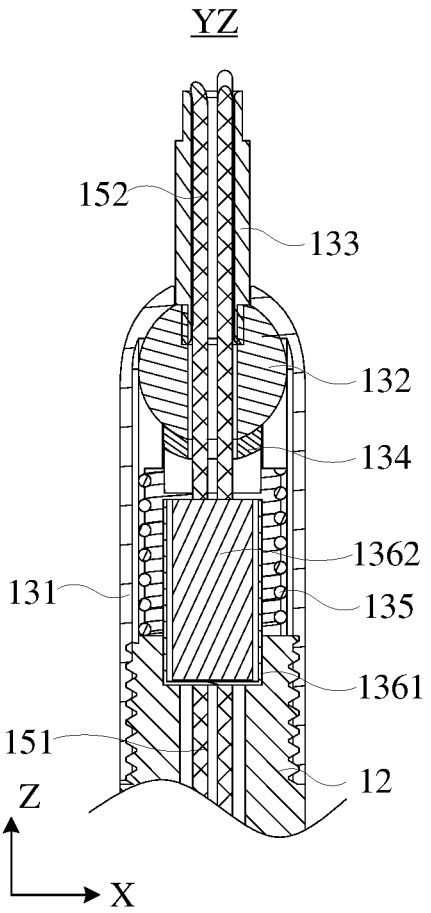
FIG. 4 is a cross-sectional view along the YZ plane of the rotatable assembly shown in FIG. 2, according to embodiments of the present disclosure.

In some embodiments, rotatable assembly 13 may include a sleeve 131, a rotatable ball 132, and a connecting arm 133. Each of sleeve 131, rotatable ball 132, and connecting arm 133 may be hollow so that cable 15, having by a first portion 151 and a second portion 152, may extend through rotatable assembly 13, e.g., sleeve 131, rotatable ball 132, and connecting arm 133. FIGS. 3 and 4 illustrate cross-sectional views of rotatable assembly 13 and other parts in plane XZ and plane YZ.

As shown in FIG. 3, sleeve 131 may be connected to (e.g., in contact with) support assembly 12 by a suitable connection means such as clamping connection, glue connection, riveting connection, and/or screw connection. In some embodiments, sleeve 131 and support assembly 12 are coupled together by a screw connection.

Rotatable ball 132 may be movably connected to sleeve 131, such that rotatable ball 132 can rotate with respect to sleeve 131. Rotatable assembly 13 (e.g., rotatable ball 132 and connecting arm 133) can thus rotate with respect to support assembly 12. Sleeve 131 may partially or fully cover/surround rotatable ball 132. In some embodiments, the fitting surface between rotatable ball 132 and sleeve 131 includes a spherical surface. The surface of rotatable ball 132 may be desirably smooth so that rotatable ball 132 can rotate with respect to sleeve 131 with less/minimum friction in between.

One end of connecting arm 133 may be connected to rotatable ball 132 by any suitable connection means such as clamping connection, glue connection, riveting connection, and/or screw connection. Illuminant assembly 14 may thus rotate to support assembly 12 through rotatable assembly 13. In some embodiments, connecting arm 133 and rotatable ball 132 are coupled by a riveting connection. In some embodiments, connecting arm 133 and illuminant assembly 14 are coupled by a screw connection. In some embodiments, connecting arm 133 and rotatable ball 132 are integrally-formed together as one piece.

A user may operate lighting device 10 with one hand or both hands. Illuminant assembly 14 may be rotated with respect to support assembly 12 in at least plane XY. In some embodiments, illuminant assembly 14 can be rotated to orient along various horizontal directions. For example, illuminant assembly 14 may be rotated around support assembly 12 (e.g., as a rotation axis) in plane XY clockwise or counter-clockwise. The angle of illuminant assembly 14 rotating in plane XY may be any value in the closed interval of [0°, 360°]. That is, the horizontal orientation of illuminant assembly 14 can be along various suitable direction in plane XY.

As shown in FIGS. 2, 3, and 4, in some other embodiments, rotatable assembly 13 may include a damping block 134 and an elastic piece 135. In some embodiments, both damping block 134 and elastic piece 135 are positioned in sleeve 131. Each of damping block 134 and elastic piece 135 may have a hollow structure, so that cable 15 may extend through damping block 134 and elastic piece 135. In some embodiments, cable 15 extends through, e.g., the entirety of, rotatable assembly 13.

One end of elastic piece 135 may be connected to (e.g., in contact with) damping block 134, and the other end of elastic piece 135 is connected to (e.g., in contact with) support assembly 12. Damping block 134 may abut against rotatable ball 132, and rotatable ball 132 may abut against sleeve 131. The fitting surface between damping block 134 and rotatable ball 132 may include a spherical surface. After illuminant assembly 14 is rotated to a desired position (and/or orientation) with respect to support assembly 12 in the plane XY, an angle between illuminant assembly 14 (e.g., angle θ shown in FIG. 7) and support assembly 12 in plane XZ can be maintained because elastic piece 135 can cause rotatable ball 132 to abut against sleeve 131, making it more convenient for a user to use lighting device 10.

Damping block 134 may include polyformaldehyde (POM) and/or polyamide (PA). In some embodiments, damping block 134 is self-lubricating, increasing the easiness of the rotatable ball 132 when being rotated with respect to sleeve 131 and damping block 134. Elastic piece 135 may include a spring and/or a hose made of an elastic material such as the PU (polyurethane).

It has found that if cable 15 extends in lighting device 10 and through support assembly 12, rotatable assembly 13, and illuminant assembly 14 respectively, with one end of cable 15 fixed to support assembly 12 and the other end fixed to illuminant assembly 14, cable 15 may rotate with illuminant assembly 14 when illuminant assembly 14 is rotated with respect to support assembly 12 in plane XY. Conventionally, the length of cable 15 is unchanged after lighting device 10 is assembled. As a result, when illuminant assembly 14 is rotated in plane XZ, cable 15 (especially the portion that extends through support assembly 12 and rotatable assembly 13) may be stretched, causing inner stress in cable 15. Cable 15 may be susceptible to tear and wear. To solve this issue, rotatable assembly 13 may include a sliding ring 136, as shown in FIGS. 2, 3, and 4. A portion of cable 15 in rotatable assembly 13 may be connected to rotatable assembly 13 through sliding ring 136. Sliding ring 136 may be located at a side of rotatable ball 132 that is away from illuminant assembly 14 and may extend through elastic piece 135.

As shown in FIG. 3, sliding ring 136 may include a stator 1361 and a rotor 1362 electrically coupled to stator 1361. Stator 1361 may be coupled to support assembly 12 by a suitable coupling means such as clamping connection, glue connection, riveting connection, and/or screw connection. Rotor 1362 is rotatable to stator 1361. For example, rotor 1362 may be located in stator 1361, and the matching relationship between stator 1361 and rotor 1362 includes clearance fit or transition fit. Some lubricant may be added between stator 1361 and rotor 1362 so that rotor 1362 can be driven by external pressure to rotate with respect to stator 1361.

Referring back to FIGS. 2, 3, and 4, cable 15 may include first portion 151 and second portion 152. One end of first portion 151 may be electrically connected to (e.g., coupled to) stator 1361, and one end of the second portion 152 may be electrically connected to rotor 1362. Second portion 152 and first portion 151 can be electrically connected to each other through sliding ring 136. In some embodiments, the other end of second portion 152 may be electrically connected to illuminant assembly 14. First portion 151 may extend through support assembly 12 and remain stationary with respect to support assembly 12. Second portion 152 may extend through rotatable ball 132 and connecting arm 133 and rotate together with illuminant assembly 14. Rotor 1362 can be driven by illuminant assembly 14 to rotate with respect to stator 1361, and possible inner stress in cable 15 can be released. That is to say, cable 15 is less likely to generate excessive stress thanks to sliding ring 136, and cable 15 is less susceptible to wear and tear.

Figure 5:
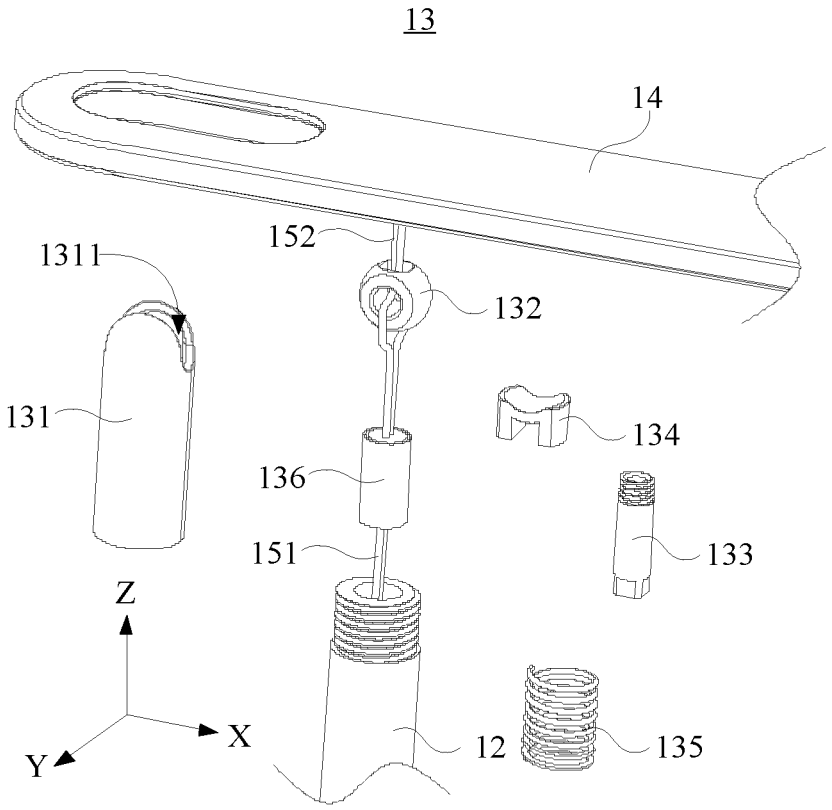
FIG. 5 is an exploded structural schematic view of a rotatable assembly shown in FIG. 1, according to another embodiment of the present disclosure.
Figure 6:
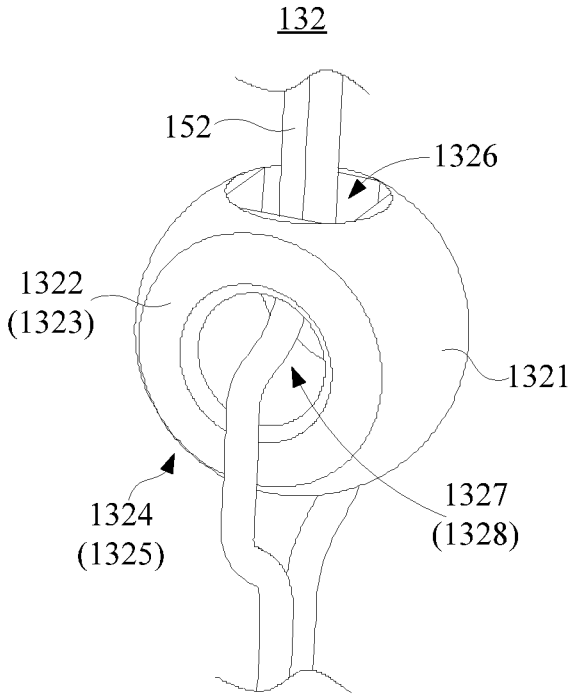
FIG. 6 is a structural schematic view of the rotatable ball of the embodiment shown in FIG. 5, according to embodiments of the present disclosure.
Figure 7:
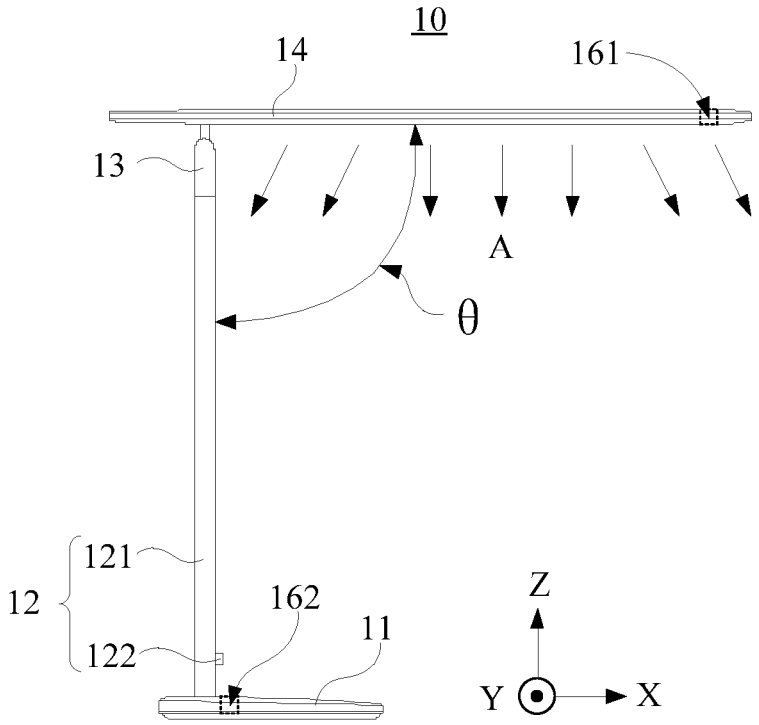
FIG. 7 is an orthographic projection view in the XZ plane of a lighting device in FIG. 1 in a first usage state, according to embodiments of the present disclosure.
Figure 8:
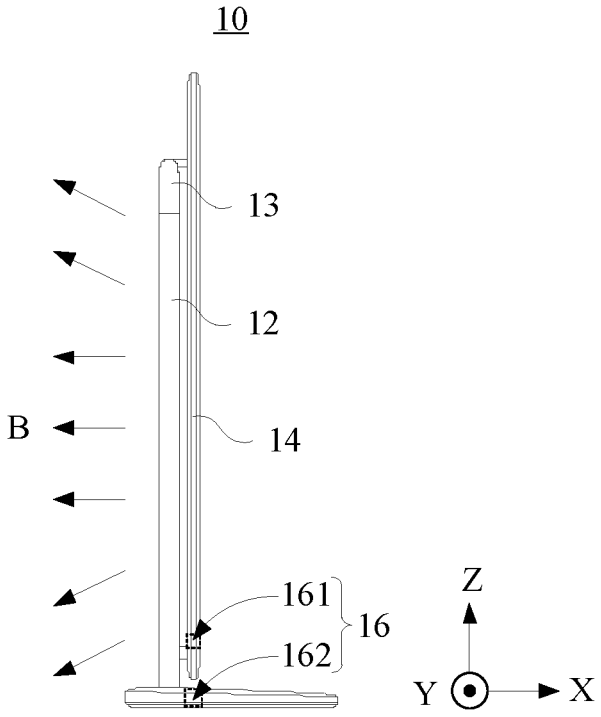
FIG. 8 is an orthographic projection view in the XZ plane of the lighting device in FIG. 1 in a second usage state, according to embodiments of the present disclosure.

FIG. 5 illustrates an exemplary assembling relationship amongst rotatable assembly 13, support assembly 12, and illuminant assembly 14. FIGS. 5 and 6 illustrate an exemplary arrangement of cable 15 located between support assembly 12 and rotatable assembly 13. FIGS. 7 and 8 illustrates relative positions between illuminant assembly 14 and support assembly 12. The value of an angle "θ" may be equal to 90° in FIG. 7 and 0° in FIG. 8, as examples.

Different from the embodiments described in FIGS. 2-4, in the embodiment illustrated in FIGS. 5-8, sleeve 131 may include a guide groove 1311. Connecting arm 133 can be inserted in guide groove 1311 so that when rotatable ball 132 rotates with respect to sleeve 131, angle θ between illuminant assembly 14 and support assembly 12, in plane XZ, can be less than or equal to a first angle threshold. In some embodiments, the first angle threshold is less than or equal to 45°. For example, the first angle threshold is equal to 45°. In some embodiments, the first angle threshold is less than or equal to 30°. For example, the first angle threshold is equal to 30°. In some embodiments, the first angle threshold is less than or equal to 10°. For example, the first angle threshold is equal to 10°. It should be pointed out that the first angle threshold may be 0° in some embodiments. FIG. 8 illustrates a scenario when the first angle threshold is 0° and illuminant assembly 14 is aligned in parallel with support assembly 12. For example, when lighting device 10 is not in use and kept in store, illuminant assembly 14 can be rotated to a position that is desirably close to support assembly 12 such that lighting device 10 can take up less space.

As shown in FIGS. 7 and 8, support assembly 12 may include a pillar 121 and a crash pad 122. One end of pillar 121 may be connected to (e.g., in contact with) rotatable assembly 13. In some embodiments, the end of pillar 121 is connected to sleeve 131, elastic piece 135, and/or sliding ring 136. The other end of pillar 121 may be connected to base assembly 11. Pillar 121 may be hollow, and cable 15 may extend through pillar 121, e.g., support assembly 12. Crash pad 122 may be positioned on an end of pillar 121 that is away from illuminant assembly 14. In some embodiments, crash pad 122 is connected to (e.g., in contact with) an end of pillar 121 that is closer to base assembly 11. When illuminant assembly 14 is rotated to a position at which angle θ between the illuminant assembly 14 and support assembly 12 is less than or equal to the first angle threshold, crash pad 122 can prevent illuminant assembly 14 from being excessively rotated. For example, crash pad 122 may prevent illuminant assembly 14 from being in contact with support assembly 12, avoiding damages in illuminant assembly 14 and/or rotatable assembly 13.

Referring back to FIG. 5, in some embodiments, sleeve 131 includes a guide groove 1311. For example, guide groove 1311 may extend the plane XZ and locate on the right side of the axis line of support assembly 12 (e.g., between illuminant assembly 14 and support assembly 12) so that illuminant assembly 14 can be rotated with respect to support assembly 12 through guide groove 1311, e.g., by an angle limited by guide groove 1311. In some embodiments, illuminant assembly 14 can be rotated with respect to support assembly 12 to a position at which angle θ is equal to 0°, as shown in FIG. 8. Nevertheless, when illuminant assembly 14 is rotated to a position at which angle θ is greater than 90°, illuminant assembly 14 cannot be further rotated upward because of the rotation of connecting arm 133 limited by sleeve 131. In plane XZ, angle θ may be any value in the closed interval [0°, 90°].

In some other embodiments, sleeve 131 includes two guide grooves 1311. For example, the two guide grooves 1311 may be in the plane XZ and respectively located on the right side and the left side (e.g., the opposite side of the right side about support assembly 12) of the axis line of support assembly 12, so that illuminant assembly 14 can be rotated to a position at which angle θ may be range from 0° to 180°. When angle θ is equal to 0°, connecting arm 133 may be inserted in guide groove 1311 located on the right side of the axis line of support assembly 12. Illuminant assembly 14 can also be rotated to a position at which angle θ is equal to 180°. When the angle is 180°, connecting arm 133 may be inserted in the guide groove 1311 located on the left side of the axis line of support assembly 12. In plane XZ, angle θ may be any value in the closed interval [0°, 180°]. It should be pointed out that when illuminant assembly 14 is rotated to the position at which illuminant assembly 14 is located on the left side of the axis line of support assembly 12, angle θ may be any value in the closed interval [0°, 180°]. In some embodiments, illuminant assembly 14 cannot be further rotated upward, because sleeve 131 may prevent connecting arm 133 from further rotation, and the value of angle θ may not exceed 180°. In some embodiments, in plane XZ, angle θ may be any value in the closed interval [0°, 90°].

Based on the embodiments above, at least plane XZ, illuminant assembly 14 can be rotated to support assembly 12. That is, illuminant assembly 14 can be rotated in a vertical plane with respect to the horizontal plane (e.g., the XY plane). In some embodiments, after illuminant assembly 14 is rotated to a position, angle θ can be maintained because elastic piece 135 squeezes damping block 134 to cause rotatable ball 132 abut against sleeve 131. In some embodiments, the position and/or orientation of illuminant assembly 14 in plane XY can also be maintained thanks to the interactions amongst elastic piece 135, damping block 134, rotatable ball 132, and sleeve 131. It may be convenient for a user to adjust illuminant assembly 14 to a desired orientation and/or position.

Based on the detailed description mentioned above, when angle θ between illuminant assembly 14 and support assembly 12 is 90°, the length direction of connecting arm 133, the axis line direction of rotatable ball 132, and the axis line direction of support assembly 12 may coincide. For example, the directions are along the direction Z. When the angle is 90°, illuminant assembly 14 can be rotated with respect to support assembly 12 in plane XY, and cable 15 is in and extends through support assembly 12 and rotatable assembly 13. In some embodiments, when the value of angle θ between deviates from 90°, the axis line direction of rotatable ball 132 may be different from the direction Z. For example, when angle θ is equal to 0° or 180°, the axis line direction of rotatable ball 132 may be substantially perpendicular to the axis line direction of support assembly 12, and thus the arrangement of cable 15 may be affected. Thus, based on the embodiment mentioned above, this embodiment will improve the structure of rotatable ball 132 so as to reduce or eliminate the interference of rotatable ball 132 to cable 15 when rotatable ball 132 rotates with respect to sleeve 131.

In some embodiments, as shown in FIG. 6, rotatable ball 132 may include a spherical surface 1321, a first surface 1322, and a second surface 1323. First surface 1322 may be located opposite to second surface 1323. Spherical surface 1321 may be connected to (e.g., in contact with) first surface 1322 and second surface 1323. In some embodiments, spherical surface 1321 is between first surface 1322 and second surface 1323. In some embodiments, the shape/contour of spherical surface 1321 is configured to match the contours/shapes of sleeve 131 and damping block 134. In some embodiments, both first surface 1322 and second surface 1323 may include flat planes. First surface 1322 may be parallel to second surface 1323. In some embodiments, rotatable ball 132 may be a ball of which two substantial portions are cut off by two parallel flat planes. When rotatable ball 132 is fit in sleeve 131, first surface 1322 and sleeve 131 may form a first clearance 1324 (e.g., space between sleeve 131 and first surface 1322), and second surface 1323 and sleeve 131 may form a second clearance 1325 (e.g., space between sleeve 131 and second surface 1323).

Spherical surface 1321 may include a primary opening 1326. First surface 1322 may include a first secondary opening 1327. Second surface 1323 may include a second secondary opening 1328. The axis line of primary opening 1326 may be along the direction Z. The axis lines of the first and the second secondary openings may coincide, e.g., along the direction Y. Each of the axis lines of primary opening 1326, the first and second secondary openings 1327 and 1328 may extend through the center (e.g., geometric center) of rotatable ball 132. In some embodiments, primary opening 1326, first secondary opening 1327, and second secondary opening 1328 are in contact with each other.

Due to the visual angle of rotatable ball 132 shown in FIG. 5 and FIG. 6, only one side structure of rotatable ball 132 can be seen. In some embodiments, the structure of rotatable ball 132 may be symmetric with respect to plane XZ, and thus the two sides of rotatable ball 132 (e.g., the sides with first and second surfaces 1322 and 1323) may be identical. That is, the structure of the invisible side of rotatable ball 132 shown in FIG. 6 may be identical to that of the shown visible side.

Connecting arm 133 may be inserted in primary opening 1326. Cable 15 (specifically, may be second portion 152 of cable 15) may be divided into a first rope and a second rope extending through rotatable ball 132 from connecting arm 133. The first rope may extend from first secondary opening 1327 and in the space of first clearance 1324, and the second rope may extend from the second secondary opening 1328 and in the space of second clearance 1325. The first rope and the second rope may re-adjoin each other to form the second portion of cable 15. In some embodiments, taking into consideration that the rotatable assembly 13 may include a damping block 134 that abuts against rotatable ball 132, after cable 15 (e.g., second portion 152 of cable 15) extends out of the first secondary opening 1327 and the second secondary opening 1327, cable 15 may split and extend around the two sides of damping block 134, i.e., go around the damping bock 134, before the split portions of cable 15 merge again.

In some other embodiments, rotatable ball 132 may only include first surface 1322 or second surface 1323. Accordingly, only one of first clearance 1324 and second clearance 1325 can be formed, and only one of first secondary opening 1327 and second secondary opening 1328 can be formed. Cable 15 (e.g., second portion 152 of cable 15) may not be divided into two ropes extending through rotatable ball 132 from connecting arm 133, and cable 15 may extend from first secondary opening 1327 or second secondary opening 1328.

By the means mentioned above, when rotatable ball 132 rotates with respect to sleeve 131 in plane XZ, cable 15 (e.g., second portion 152 of cable 15) may rotate together with rotatable ball 132 in plane XZ, and the interference to cable 15 will be decreased.

Other structures of this embodiment are identical or similar to those of the embodiments mentioned above and the detailed descriptions of the structures may be referred to the embodiments mentioned above and are not provided herein.

Referring to FIG. 7 and FIG. 8, the arrows A in FIG. 7 may represent the lighting directions of illuminant assembly 14 of lighting device 10 in a first usage state, and the arrows B in FIG. 8 may represent the lighting directions of illuminant assembly 14 of lighting device 10 in a second usage state.

In the embodiment, as shown in FIGS. 7 and 8, lighting device 10 may include a switch assembly 16. When the illuminant assembly 14 is rotated to a position at which angle θ, in plane XZ, between illuminant assembly 14 and support assembly 12, is less than or equal to the first angle threshold, switch assembly 16 can be turned to an on-state, e.g., a power-on state. The beneficial effects are as follows: The lighting device provided by the foregoing embodiment of the disclosure includes a support assembly, an illuminant assembly, and a switch assembly. Because when the illuminant assembly is rotated to a position in which an angle between the illuminant assembly and the support assembly is less than or equal to a first angle threshold, the switch assembly turns to be on-state, and thus the lighting device has the function of a switch.

Switch assembly 16 may include a trigger 161 and a sensor 162. One of trigger 161 and sensor 162 is positioned at the end of illuminant assembly 14 that is away from support assembly 12, and the other of trigger 161 and sensor 162 is positioned at the end of support assembly 12 that is away from illuminant assembly 14. For illustrative purposes, in some embodiments, a trigger 161 may be located in illuminant assembly 14 and/or a sensor 162 may be located in base assembly 11, so that the consistency of the visible structure of lighting device 10 can be improved. In some embodiments, when illuminant assembly 14 is rotated to a position at which angle θ between illuminant assembly 14 and support assembly 12 is less than or equal to the first angle threshold, sensor 162 is triggered by trigger 161 to turn switch assembly 16 to the on-state.

In some embodiments, trigger 161 includes a magnet, such as a permanent magnet. Generally, a spherical magnetic field will be formed around a magnet. The magnetic field from the magnet decreases gradually with increasing distance. When illuminant assembly 14 is rotated with respect to support assembly 12 in the plane XZ, if the angle θ between illuminant assembly 14 and support assembly 12 changes from 90° to 0 or from 180° to 0°, the distance between trigger 161 and sensor 162 decreases gradually. The strength of the magnetic field of trigger 161 applied on sensor 162 may increase gradually.

Sensor 162 may include a hall sensor. When the strength of the magnetic field applied on the hall sensor is greater than a strength threshold, the electric current generated by the hall sensor may be transformed into a control signal that can turn switch assembly 16 to the on-state. In some embodiments, sensor 162 includes a magnetic reed switch. When the strength of the magnetic field applied on the magnetic reed switch is greater than a strength threshold, the magnetic reeds of the magnetic reed switch start to contact each other and then turns switch assembly 16 to the on-state.

By the above-mentioned means, when illuminant assembly 14 is rotated to a position at which angle θ is less than or equal to the first angle threshold, the strength of the magnetic field of trigger 161 applied on sensor 162 is greater than or equal to the strength threshold. Switch assembly 16 may be turned to the on-state.

It should be pointed out that the first angle threshold may be less than or equal to 45°. In some embodiments, the first angle threshold is less than or equal to 30°. In some embodiments, the first angle threshold is less than or equal to 10°. The strength threshold mentioned above is correlated not only with the first angle threshold but also with the magnetic strength of trigger 161 and the sensitivity of sensor 162. There is no limitation to the value of the magnetic field strength. That is, the value of the magnetic field strength can be reasonably designed based on the above-mentioned factors.

In some other embodiments, sensor 162 includes a capacitive sensor, and trigger 161 includes a media. When illuminant assembly 14 is rotated to a position at which angle θ is less than or equal to the first angle threshold, trigger 161 may be close to or may contact sensor 162. A change of the capacitance quantity of sensor 162 is caused by trigger 161, and the change may be transformed into a control signal that can turn switch assembly 16 to the on-state.

In some other embodiments, sensor 162 includes an inductive transducer, and trigger 161 includes a sheet metal. When illuminant assembly 14 is rotated to a position at which angle θ is less than or equal to the first angle threshold, trigger 161 may be close to or may contact sensor 162. The oscillation of sensor 162 may be weakened, caused by an eddy current generated by trigger 161. The change/reduction of oscillation may be transformed into a control signal that can turn switch assembly 16 to the on-state.

Based on the detailed description mentioned above, when angle θ is greater than the first angle threshold, e.g., equal to 90° as shown in FIG. 7, trigger 161 is too far from sensor 162 to trigger sensor 162. In some embodiments, switch assembly 16 is maintained at a power-off state. When the angle between illuminant assembly 14 and support assembly 12 is 0°, that is to say, lighting device 10 has a configuration shown in FIG. 8, trigger 161 is sufficiently close to sensor 162 to trigger sensor 162 and then switch assembly 16 is turned to the on-state. The usage states of lighting device 10 may be switched from one state to the other, and thus trigger 161 and sensor 162 may function as a switch.

In some embodiments, switch assembly 16 may be electrically connected to illuminant assembly 14. When switch assembly 16 is at the on-state, switch assembly 16 can turn on illuminant assembly 14 to emit light. Because the volume of illuminant assembly 14 is much greater than that of the button(s) of base assembly 11, a user may not find the button(s) easily at night (e.g., in the dark). In some other scenarios, a user may rotate illuminant assembly 14 to a position at which illuminant assembly 14 is sufficiently close to support assembly 12 such that switch assembly 16 can be turned to the on-state, as shown in FIG. 8. Switch assembly 16 can thus turn on illuminant assembly 14 to emit light. The use of lighting device 10 may be more convenient.

In some other embodiments, lighting device 10 is configured to interact with an air conditioner, a TV, and/or other domestic appliances. Switch assembly 16 may function as a remote switch of these domestic appliances, and lighting device 10 may function as a controller for the domestic appliance. When a user cannot find the controller of the domestic appliance or in other scenarios, the user can turn the domestic appliances on or off by operating lighting device 10.

Figure 9:
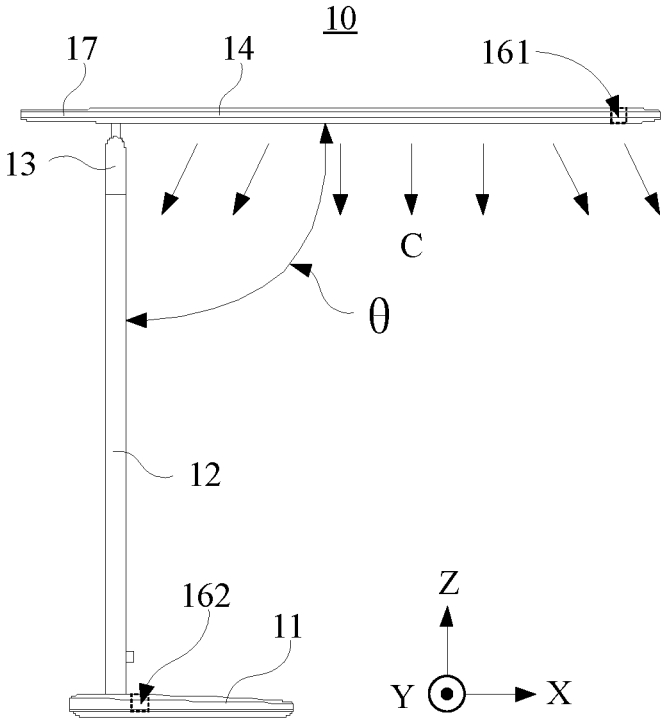
FIG. 9 is an orthographic projection view in the XZ plane of another lighting device, according to embodiments of the present disclosure.
Figure 10:
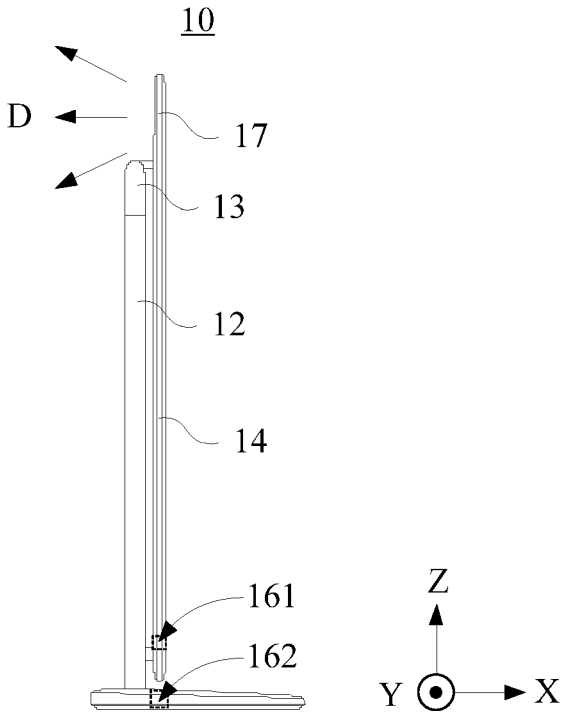
FIG. 10 is an orthographic projection view in the XZ plane of the lighting device in FIG. 9 in another usage state, according to embodiments of the present disclosure.

FIG. 9 illustrates a non-zero angle θ (e.g., equal to 90°) between illuminant assembly 14 and support assembly 12. Lighting device 10 may be in the first usage state. FIG. 10 illustrates angle θ, equal to 0°, between illuminant assembly 14 and support assembly 12. Lighting device 10 may be at the second usage state. The arrows "C" shown in FIG. 9 are used to show the lighting directions of illuminant assembly 14 and that illuminant assembly 14 is maintained at the lighting state (e.g., a state that the illuminant assembly emits light). The arrows "D" shown in FIG. 10 are used to show the lighting directions of a second illuminant assembly 17 and that second illuminant assembly 17 is maintained at the lighting state.

The main differences between light device 10 in FIGS. 9 and 10 and lighting device 10 shown in FIGS. 1-7 includes that, in this embodiment, lighting device 10 may include second illuminant assembly 17. Second illuminant assembly 17 may be connected to (e.g., in contact with) illuminant assembly 14 and may be rotated to support assembly 12 together with illuminant assembly 14. In other words, second illuminant assembly 17 and illuminant assembly 14 can be rotated with respect to support assembly 12 as a whole (e.g., one piece).

In some embodiments, switch assembly 16 is electrically connected to at least second illuminant assembly 17. When switch assembly 16 is at on-state, switch assembly 16 can turn at least second illuminant assembly 17 on to emit light. For example, switch assembly 16 is electrically connected to second illuminant assembly 17, and when switch assembly 16 is on-state, switch assembly 16 can turn second illuminant assembly 17 on to emit light. In another example, switch assembly 16 may be electrically connected to illuminant assembly 14 and second illuminant assembly 17. When switch assembly 16 is at the on-state, i.e., angle θ less than or equal to the first angle threshold, switch assembly 16 can turn illuminant assembly 14 and second illuminant assembly 17 to emit light. When angle θ is 0°, as shown in FIG. 10, second illuminant assembly 17 may be above rotatable assembly 13, and illuminant assembly 14 may be below rotatable assembly 13. Switch assembly 16 may turn second illuminant assembly 17 on to emit light, and the lighting directions of second illuminant assembly 17 are towards a second side (e.g., the side opposite of the side facing illuminant assembly 14) of support assembly 12. When angle θ is equal to 90° as shown in FIG. 9, illuminant assembly 14 is on a first side (e.g., the side facing illuminant assembly 14) of support assembly 12, and second illuminant assembly 17 is on the second side opposite of the first side of support assembly 12.

In some embodiments, as shown in FIG. 9 and FIG. 10, support assembly 12 or rotatable assembly 13 may be located between illuminant assembly 14 and second illuminant assembly 17. In some embodiments, illuminant assembly 14 and second illuminant assembly 17 are located at two sides of support assembly 12 in plane XZ. In some embodiments, illuminant assembly 14 and second illuminant assembly 17 are located at two sides of rotatable assembly 13 in plane XZ.

It should be pointed out that when second illuminant assembly 17 at in the lighting state, the lighting directions of second illuminant assembly 17 may be towards the left side or the right side of support assembly 12 in plane XZ, or may be towards both the left and right sides of support assembly 12 in plane XZ. In the embodiment, the lighting directions of second illuminant assembly 17 are towards the left side of support assembly 12 in plane XZ.

Figure 11:
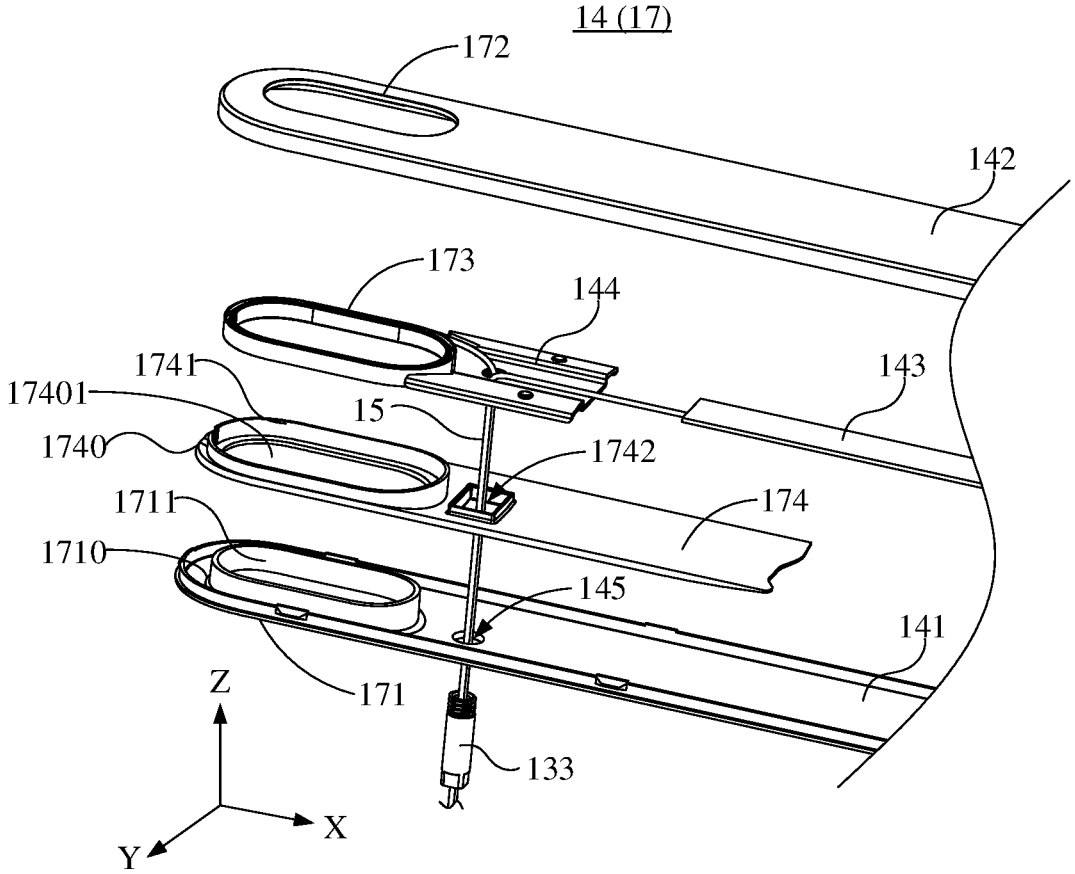
FIG. 11 is an exploded schematic view of an illuminant assembly and a second illuminant assembly in FIG. 9, according to embodiments of the present disclosure.
Figure 12:
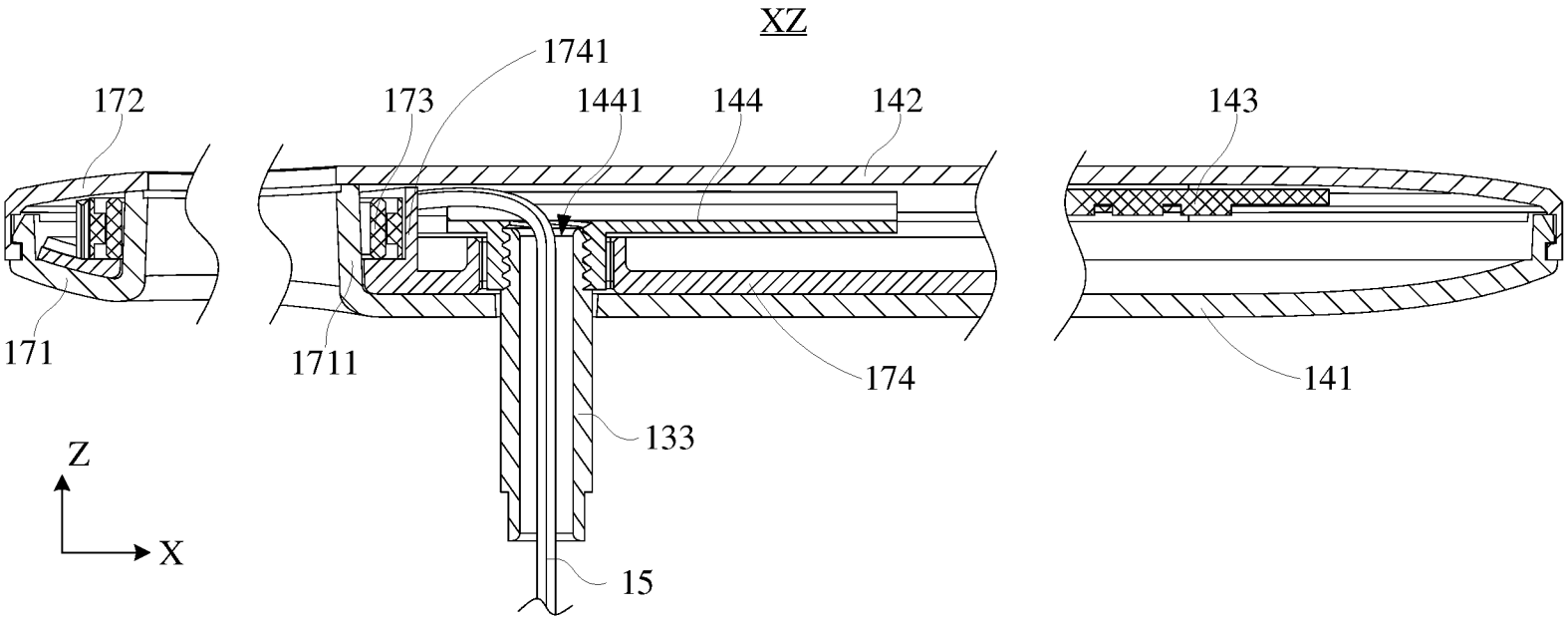
FIG. 12 is an orthographic projection view in the XZ plane of the illuminant assembly and the second illuminant assembly in FIG. 11, according to embodiments of the present disclosure.

Referring to FIG. 11 and FIG. 12, both of illuminant assembly 14 and second illuminant assembly 17 may have a column-shaped structure, a disk-shaped structure, and/or an annular structure. In some embodiments, illuminant assembly 14 has a column-shaped structure and second illuminant assembly 17 has an annular structure.

As shown in FIGS. 11 and 12, in some embodiment, illuminant assembly 14 includes a first lampshade 141, a first board 142, and a light bar 143. First board 142 may be assembled with first lampshade 141 by suitable means such as clamping connection, glue connection, riveting connection, and/or screw connection. First board 142 and the lampshade 141 may form a first accommodation cavity, and light bar 143 may be accommodated in (e.g., located in) the first accommodation cavity. Light bar 143 may be positioned along direction X. Light bar 143 may be electrically connected to cable 15 (e.g., second portion 152 of cable 15) so that light bar 143 can emit light. In some embodiments, first lampshade 141 includes transparent materials, and first board 142 includes lightproof materials, so that a maximum/optimized amount of light emitted by light bar 143 can pass through first lampshade 141 and a relatively stable lighting direction of illuminant assembly 14 can be formed. In some embodiments, one side of first board 142 that is close to first lampshade 141 may be positioned with a reflector(s) or coated with reflective materials, so that the light emitted by light bar 143 may pass through the lampshade 141 in the lighting direction of illuminant assembly 14. The illuminant intensity of illuminant assembly 14 may be increased, and the energy consumption may be decreased.

In some embodiments, because the dimension of illuminant assembly 14 along direction Z may be small, to improve the connection between illuminant assembly 14 and rotatable assembly 13 (e.g., connecting arm 133) or strengthen the connection reliability between illuminant assembly 14 and rotatable assembly 13, illuminant assembly 14 may include a mounting board 144. Mounting board 144 may be located between first lampshade 141 and first board 142 and connected to (e.g., in contact with) at least one of first lampshade 141 and first board 142. In some embodiments, mounting board 144 includes a third mounting opening 1441 (located on the backside of mounting board 144 and not visible in FIG. 11). Connecting arm 133 may extend through third mounting opening 1441 and be connected to mounting board 144 by screw, and thus the assembling between illuminant assembly 14 and rotatable assembly 13 can be formed.

As shown in FIGS. 11 and 12, in some embodiments, second illuminant assembly 17 may include a second lampshade 171, a second board 172, and a ring light 173. Second board 172 may be assembled with second lampshade 171 by suitable means such as clamping connection, glue connection, riveting connection, and/or screw connection. Second lampshade 171 may face support assembly 12, and second board 172 may be positioned away from support assembly 12 (e.g., opposite of second lampshade 171). Second board 172 and second lampshade 171 may form a second accommodation cavity. Ring light 173 may be accommodated (e.g., positioned) in the second accommodation cavity. Ring light 173 may be electrically connected to cable 15 (e.g., second portion 152), and ring light 173 can glow. In some embodiments, second lampshade 171 may include transparent materials and second board 172 may include lightproof materials, so that a maximum/optimized portion of the light emitted by ring light 173 can pass through second lampshade 171, and relatively stable lighting directions of second illuminant assembly 17 can be formed. In some embodiments, one side of second board 172 that is close to second lampshade 171 may be positioned with a reflector(s) or coated with reflective materials, so that the light emitted by ring light 173 may pass through second lampshade 171 in the lighting direction of second illuminant assembly 17, and the illuminant intensity of second illuminant assembly 17 may be increased, and the energy consumption may be decreased.

Because second illuminant assembly 17 may be connected to (e.g., in contact with) illuminant assembly 14, to simplify the structure of lighting device 10, many structures mentioned above may be designed to be integrally formed or universal parts. For example, second lampshade 171 and first lampshade 141 may be designed to be integrally formed. Second board 172 and the first board 142 may be designed to be integrally formed. Second lampshade 171 and first lampshade 141 are integrally formed as a whole (e.g., one piece). As shown in FIG. 11, the surface of second lampshade 171 and/or first lampshade 141 may include a fourth mounting opening 145. The axis line of fourth mounting opening 145 may be the same as that of third mounting opening 1441 along the direction Z. In some embodiments, connecting arm 133 extends through first lampshade 141. In some embodiments, connecting arm 133 extends through both first lampshade 141 and second lampshade 171 and assembles with mounting board 144. In another example, second illuminant assembly 17 and illuminant assembly 14 may be jointly connected to mounting board 144, so that second illuminant assembly 17 and illuminant assembly 14 may be assembled with rotatable assembly 13 as a whole (e.g., one piece). In some embodiments, ring light 173 and light bar 143 are positioned on mounting board 144. As shown in FIG. 11, rotatable assembly 13 is connected to a segment of first lampshade 141 and/or second lampshade 171, and the segment is located between ring light 173 and light bar 143.

In some embodiments, ring light 173 has an annular shape. To position ring light 173, second illuminant assembly 17 may include a supplementary board 174. Supplementary board 174 may be located between second lampshade 171 and second board 172. In some embodiments, supplementary board 174 is connected to (e.g., in contact with) at least one of second lampshade 171 and second board 172. In some embodiments, supplementary board 174 includes a board body 1740 and a first annular protrusion 1741. First annular protrusion 1741 extends from board body 1740. Second lampshade 171 includes a lampshade body 1710 and a second annular protrusion 1711. Second annular protrusion 1711 extends from lampshade body 1710. Board body 1740 defines a through hole 17401. Through hole 17401 is surrounded by first annular protrusion 1741. After supplementary board 174 is assembled with second lampshade 171, second annular protrusion 1711 is located in through hole 17401, and an annular gap (not marked in FIG. 11) is formed between first annular protrusion 1741 and second annular protrusion 1711. Ring light 173 is accommodated in an annular gap and located between first annular protrusion 1741 and second annular protrusion 1711. One side of first annular protrusion 1741 that is close to second annular protrusion 1711 may include a reflector(s) or coated with reflective materials, so that the light emitted by ring light 173 may be emitted along the lighting direction of second illuminant assembly 17, and thus the illuminant intensity of second illuminant assembly 17 may be increased, and the energy consumption may be decreased. In some embodiments, supplementary board 174 includes a fifth mounting opening 1742, and the axis line of the fifth mounting opening 1742 may be the same as that of fourth mounting opening 145 and/or that of third mounting opening 1441 along the direction Z, so that connecting arm 133 can extend through first lampshade 141. In some embodiments, connecting arm 133 may extend through both first lampshade 141, second lampshade 171, supplementary board 174, and be assembled with mounting board 144. Centers of third mounting opening 1441, fourth mounting opening 145, and fifth mounting opening 1742 may be located in a straight line (e.g., direction Z). In some embodiments, one end of connecting arm 133 is connected to rotatable ball 132, and another end of connecting arm 133 extends through the third mounting opening 1441, fourth mounting opening 145, and the fifth mounting opening 1742.

It should be pointed out that lighting device 10 described in the disclosure is equipped with only one illuminant assembly. That is, the detailed structures of illuminant assembly 14 may be similar or identical to the embodiments mentioned above.

The above-described embodiments are partial embodiments of the disclosure and cannot be considered as the limitation of the protection scope of the disclosure. All equivalent devices or processes obtained from the specification and the accompanying drawings and directly or indirectly applied to other relevant technical fields, fall in the protection scope of the disclosure.

The invention claimed is:

1. A lighting device, comprising:

a support assembly;

an illuminant assembly connected to the support assembly and configured to be rotatable relative to the support assembly, wherein the illuminant assembly comprises:

a first lampshade facing the support assembly, a first board assembled with the first lampshade, the first lampshade and the first board forming a first accommodation cavity, and a light bar accommodated in the first accommodation cavity;

a switch assembly which is turned to an on-state by the illuminant assembly being rotated to a position at which an angle between the illuminant assembly and the support assembly is less than or equal to a first angle threshold;

a rotatable assembly, wherein one end of the rotatable assembly is connected to the support assembly, and another end of the rotatable assembly is connected to the illuminant assembly; and the illuminant assembly is rotatable to the support assembly through the rotatable assembly; and a second illuminant assembly connected to the illuminant assembly and configured to be rotatable to the support assembly with the illuminant assembly through the rotatable assembly, wherein the second illuminant assembly comprises:

a second lampshade facing the support assembly, a second board assembled with the second lampshade, the second lampshade and the second board form a second accommodation cavity, and a ring light accommodated in the second accommodation cavity; and wherein:

the first board and the second board are integrally formed, the first lampshade and the second lampshade are integrally formed, and the first accommodation cavity is in contact with the second accommodation cavity.

2. The lighting device of claim 1, wherein when the switch assembly is turned to the on-state, the switch assembly turns the illuminant assembly on to emit light.

3. The lighting device of claim 1, wherein:

the switch assembly comprises a sensor and a trigger;

one of the sensor and the trigger is positioned at an end of the illuminant assembly that is away from the support assembly, and the other of the sensor and the trigger is positioned at an end of the support assembly that is away from the illuminant assembly; and when the angle is less than or equal to the first angle threshold, the trigger triggers the sensor so that the switch assembly is turned to the on-state.

4. The lighting device of claim 3, wherein the trigger is a magnet, and when the angle between the illuminant assembly and the support assembly is less than or equal to the first angle threshold, a strength of a magnetic field that the magnet applies on the sensor is greater than or equal to a strength threshold such that the sensor is triggered and the switch assembly is turned to the on-state.

5. The lighting device of claim 4, wherein the sensor is a hall sensor, and when the strength of the magnetic field that the magnet applies on the sensor is greater than or equal to the strength threshold, the hall sensor generates an electric current such that the switch assembly is turned to the on-state.

6. The lighting device of claim 4, wherein the sensor is a magnetic reed switch, and when the strength of the magnetic field that the magnet applies on the magnetic reed switch is greater than or equal to the strength threshold, magnetic reeds of the magnetic reed switch are in contact with each other such that the switch assembly is turned to the on-state.

7. The lighting device of claim 1, wherein the first angle threshold is less than or equal to 45°.

8. The lighting device of claim 1, wherein:

the support assembly comprises a pillar and a crash pad, one end of the pillar being connected to the illuminant assembly and the crash pad being positioned at another end of the pillar that is away from the illuminant assembly; and when the illuminant assembly is rotated to the position at which the angle is less than or equal to the first angle threshold, the crash pad prevents the illuminant assembly from contacting the pillar.

9. The lighting device of claim 1 wherein:

the rotatable assembly comprises a sleeve connected to the support assembly, a rotatable ball rotatably connected to the sleeve, and a connecting arm; and one end of the connecting arm is connected to the rotatable ball, and another end of the connecting arm is connected to the illuminant assembly.

10. The lighting device of claim 9, wherein:

the rotatable assembly further comprises a damping block and an elastic piece positioned in the sleeve; and one end of the elastic piece is connected to the damping block, and another end of the elastic piece is connected to the support assembly such that the damping block abuts against the rotatable ball and the rotatable ball abuts against the sleeve.

11. The lighting device of claim 1, wherein:

when the switch assembly is turned to the on-state, the switch assembly turns the second illuminant assembly on to emit light.

12. The lighting device of claim 11, wherein:

when the angle is 0°, the second illuminant assembly is above the rotatable assembly and the illuminant assembly is below the rotatable assembly; and when the angle is 90°, the illuminant assembly is on a first side of the support assembly and the second illuminant assembly is on a second side opposite of the first side of the support assembly.

13. The lighting device of claim 12, wherein when the angle is 0° and the switch assembly turns the second illuminant assembly on to emit light, lighting directions of the second illuminant assembly are towards the second side of the support assembly.

14. The lighting device of claim 13, wherein when the angle is 90°, the switch assembly turns the illuminant assembly on to emit light.

15. The lighting device of claim 9, wherein:

the rotatable assembly further comprises a sliding ring located at a side of the rotatable ball away from illuminant assembly and extending through elastic piece; and the sliding ring comprises a stator and a rotor electrically coupled to and rotatable to the stator.

16. The lighting device of claim 1, wherein:

the rotatable assembly is connected to at least one of the first lampshade or the second lampshade; and a location of the connection is between the ring light and the light bar.

17. The lighting device of claim 1, wherein:

the illuminant assembly further comprises a mounting board between and connected to at least one of the first lampshade and the first board, the mounting board comprising a third mounting opening between and connected to the ring light and the light bar;

the second illuminant assembly further comprises a supplementary board between and connected to at least one of the second lampshade and the second board;

one of the second lampshade and the first lampshade comprises a fourth mounting opening, and the supplementary board includes a fifth mounting opening, the fourth mounting opening and the fifth mounting opening being located between the ring light and the light bar; and centers of the third mounting opening, the fourth mounting opening, and the fifth mounting opening are located in a straight line.

18. The lighting device of claim 17, wherein:

the rotatable assembly comprises a sleeve connected to the support assembly, a rotatable ball movably connected to the sleeve, and a connecting arm; and one end of the connecting arm is connected to the rotatable ball, and another end of the connecting arm extends through the third mounting opening, the fourth mounting opening, and the fifth mounting opening.

19. The lighting device of claim 17, wherein:

the supplementary board comprises a board body and a first annular protrusion extending from the board body, the board body defining a through hole surrounded by the first annular protrusion;

the second lampshade comprises a lampshade body and a second annular protrusion extending from the lampshade body; and after the supplementary board is assembled with the second lampshade, the second annular protrusion is located in the through hole and an annular gap is formed between the first annular protrusion and the second annular protrusion, and the ring light is accommodated in the annular gap and located between the first annular protrusion and the second annular protrusion.

* * * * *